US006251023B1

(12) United States Patent
Lauro et al.

(10) Patent No.: US 6,251,023 B1
(45) **Date of Patent: *Jun. 26, 2001**

(54) OPEN TOP SWING

(75) Inventors: Charles W. Lauro, Southern Pines, NC (US); Thomas N. Koltun, Chicago; Peter J. Myers, Wheaton, both of IL (US)

(73) Assignee: Kolcraft Enterprises, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/470,544

(22) Filed: Dec. 22, 1999

Related U.S. Application Data

(63) Continuation of application No. 09/132,094, filed on Aug. 10, 1998, now Pat. No. 6,010,410, which is a continuation of application No. 08/707,360, filed on Sep. 4, 1996, now Pat. No. 5,791,999, which is a continuation of application No. 08/514,265, filed on Aug. 11, 1995, now abandoned.

(51) Int. Cl.[7] ..... A63G 9/00
(52) U.S. Cl. ..... 472/118
(58) Field of Search ..... 472/118, 119, 472/120, 121, 122, 123, 124; 297/344.12, 344.18

(56) References Cited

U.S. PATENT DOCUMENTS

| | | | |
|---|---|---|---|
| D. 351,289 | 10/1994 | Stephens et al. | D6/344 |
| D. 359,857 | 7/1995 | Bartlett | D6/347 |
| D. 392,126 | 3/1998 | Sack | D6/491 |
| 2,525,377 | 10/1950 | Schwartz | 472/121 |
| 2,797,738 | 7/1957 | Patterson | 297/344.18 |
| 4,324,432 | 4/1982 | Eldon, III et al. | 297/377 |
| 4,325,578 | 4/1982 | Borucki | 297/281 |
| 4,452,446 | 6/1984 | Saint | 272/86 |
| 4,589,657 | 5/1986 | Saint | 272/85 |
| 4,807,872 | 2/1989 | Spilman et al. | 272/86 |
| 4,822,033 | 4/1989 | Kohus et al. | 472/119 |
| 4,940,229 | 7/1990 | Foster | 472/119 |
| 5,083,773 | 1/1992 | Saint | 272/86 |
| 5,326,327 | 7/1994 | Stephens et al. | 472/119 |
| 5,525,113 | 6/1996 | Mitchell et al. | 472/119 |
| 5,533,936 | 7/1996 | Julien et al. | 472/118 |
| 5,628,689 | 5/1997 | Saint et al. | 472/118 |
| 5,769,727 | 6/1998 | Fair et al. | 472/118 |
| 5,791,999 * | 8/1998 | Lauro et al. | 472/118 |
| 5,803,817 | 9/1998 | Stern | 472/118 |
| 6,010,410 * | 1/2000 | Lauro et al. | 472/118 |

OTHER PUBLICATIONS

Advertisement displaying Graco's Advantage™ baby swing, Model 1452ND, Navy Dot (undated).
Advertisement displaying Graco's Advantage™ baby swing, Model 1452MW, Milky Way (undated).
Brochure (p. 3) displaying Kolcraft's Lil' Swinger™ infant swing, Model 14902–EJ, 1993.

* cited by examiner

*Primary Examiner*—Kien T. Nguyen
(74) *Attorney, Agent, or Firm*—Marshall, O'Toole, Gerstein, Murray & Borun

(57) ABSTRACT

An open top swing which includes a frame and mounting housings. A swing assembly depends from the pivot pins and includes a pair of spaced legs to which a swing is releasably attached for moving the swing closer to or away from the pivot pins to permit a change in the swing speed and the distance of the arcuate path that the swing will travel.

8 Claims, 2 Drawing Sheets

OPEN TOP SWING

This is a Continuation of U.S. application Ser. No. 09/132,094, filed Aug. 10, 1998, now U.S. Pat. No. 6,010, 410, which is itself a continuation of U.S. application Ser. No. 08/707,360, filed Sep. 4, 1996, (now U.S. Pat. No. 5,791,999) which is itself a file wrapper continuation of Ser. No. 08/514,265, filed Aug. 11, 1995 abandoned.

BACKGROUND OF THE INVENTION

The invention disclosed herein relates generally to an open top infant swing, and, more particularly, to an improved infant swing having a system for adjusting the height of the swing seat.

DESCRIPTION OF THE PRIOR ART

Open top infant swings are presently available on the market. The devices generally include a base or frame member which is disposed on the ground surface. A swing assembly is connected to and depends from the frame, the swing assembly being adapted to pivot relative to the frame assembly, the desired movement being generated either manually or by means of a drive motor.

While such swing assemblies are generally satisfactory, certain disadvantages exist. It has been found that, in some instances, when an infant is placed in the swing assembly, a mother or operator is concerned because the drive motor will not only cause the swing to travel over too great an arc, but the swing speed is too rapid for the particular child.

Moreover, it sometimes is desired to position the infant who is located in the swing further off the ground so that the child is positioned closer to a mother for feeding and the mother does not have to bend over as far to place the child in the seat. Accordingly, it is desired to have an open top swing with some means for selecting the swing speed and arch of swing travel. It also is desired to have a swing device where the position of the seat relative to the frame can be adjusted along a vertical axis.

SUMMARY OF THE INVENTION

Applicant's invention serves to obviate the above-described disadvantages while at the same time achieving the particular desires sought for an infant swing assembly.

Briefly, applicant's invention, as disclosed and claimed herein, is directed to an open top swing having a swing assembly which depends from a frame assembly with the swing seat being adapted to rotate relative to the swing frame. The swing assembly preferably comprises a U-shaped member which includes a pair of legs each of which depends from a pivot pin located in a mounting housing. The pivot pins may be rotated either manually or by means of a conventional drive motor attached to a pivot pin.

A clamp assembly is connected to each side of a swing seat. The assemblies, in turn, are adjustably coupled to the seat support leg of the U-shaped member whereby the seat can be selectively raised or lowered to a desired position along the length of the legs.

When a child is quite young and a parent wishes the seat to travel to a short arc at a relatively low speed, the seat is raised on the leg members to a position contiguous to the pivot pins. As a child grows, however, and it is desired to increase the arcuate path of travel of the swing as well as the swing speed, the seat is adjusted to a position on the legs located further away from the pivot pins.

DETAILED DESCRIPTION OF THE DRAWINGS

Figure 1:
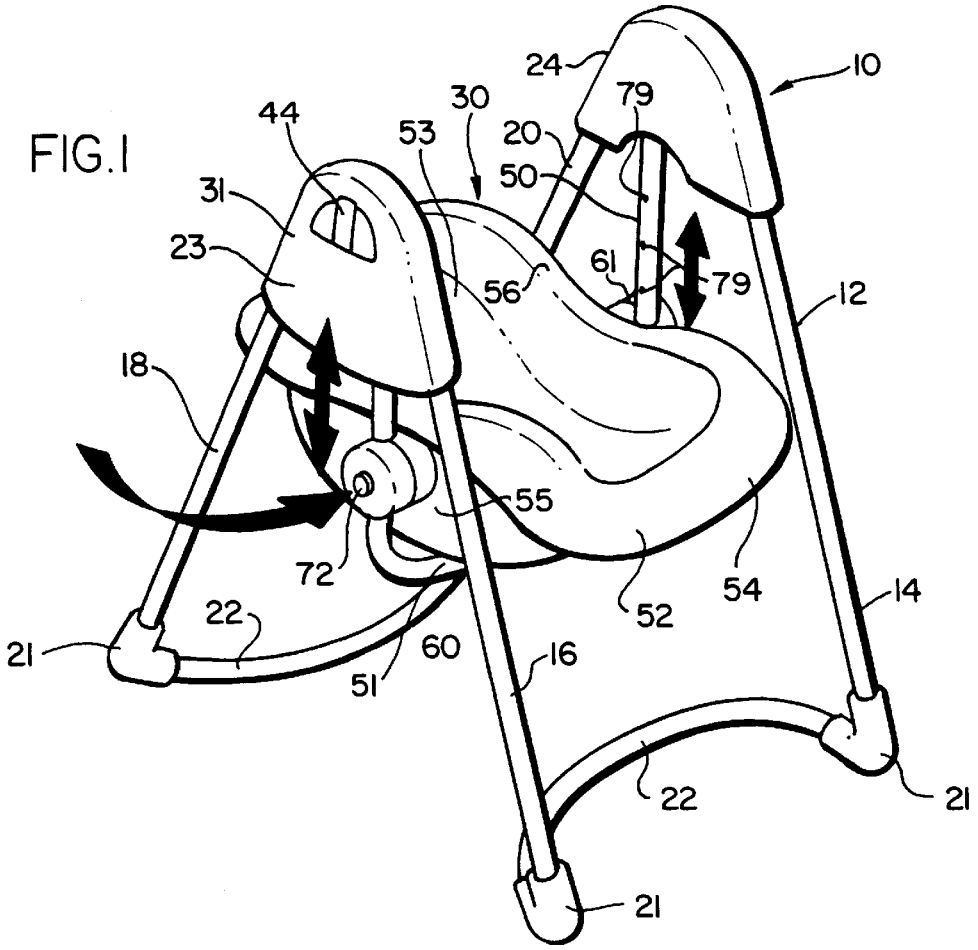
FIG. 1 shows a perspective view of the open top swing of the present invention with the swing disposed in one position relative to a pair of pivot pins about which the swing rotates.

Referring to the drawings, there is illustrated an open top swing 10 utilized to hold a young infant or child. Swing 10 includes frame 12 which comprises plastic or metal tubular frame legs 14, 16, 18, and 20. The bottom end of each leg is fastened to one end of connector 21 while the remaining end of connector 21 is fastened to a curved base member 22 which is adapted to seat on the ground surface to support and stabilize swing 10.

Frame legs 16 and 18 converge at their respective top leg ends and are mounted in housing 23. Similarly, legs 14 and 20 converge at their respective top leg ends and are mounted in housing 24. In the particular swing embodiment illustrated, housing 23 also serves to house a swing motor which, when actuated, drives swing assembly 30. If desired, a motor also can be incorporated into housing 24.

Figure 2:
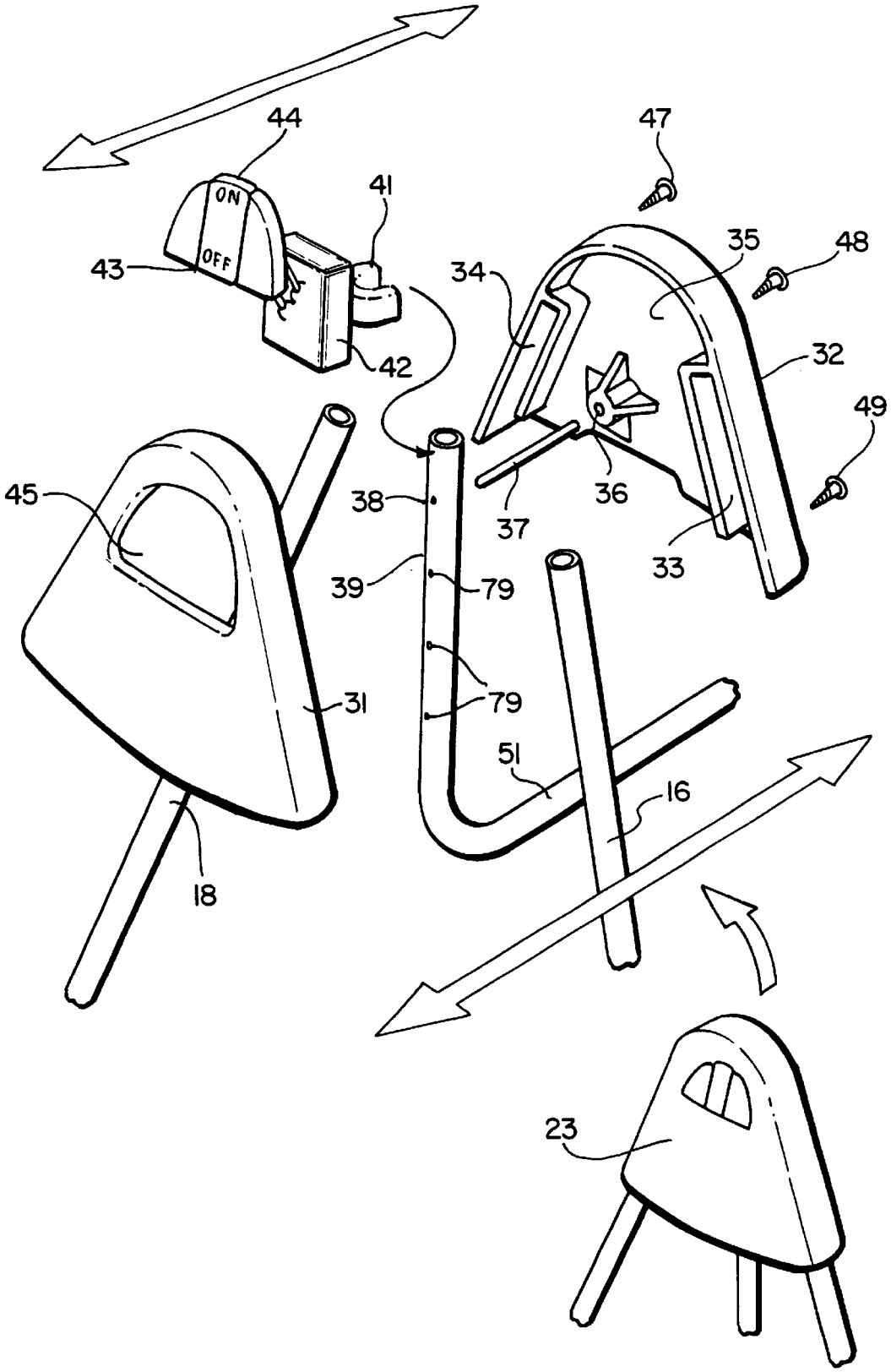
FIG. 2 shows an exploded, fragmentary view of one of two swing mounting housings and the associated swing parts.

Referring more particularly to FIG. 2, there is shown an exploded view of motor housing 23 and swing assembly 30. Housing 23 includes an outer housing shell 31 and inner housing shell 32. The top end of frame leg 16 is adapted to seat in a shell recess 33 while the top end of frame leg 18 is adapted to seat in shell recess 34. A pivot pin mounting member 36 extends outwardly from inner shell surface 35. It is adapted to receive and support one end of pivot pin 37.

The remaining end of pivot pin 37 is adapted to pass through both opening 38 in seat support leg 39 (to be described) and an opening, not shown, in pin bushing 41 where it connects to a conventional swing drive motor 42. Motor 42 is maintained against motor actuated button member 43 which is located in a recess in outer housing shell 31. The "on" and "off" button 44 of member 43 appears within housing opening 45. Swing actuator motor 42 may be any conventional motor presently utilized to rotate a drive shaft or pivot member of a swing assembly. If desired, motor 42 could be eliminated and a pivot pin mounted within housing 23 whereby swing assembly 30 is pivoted manually relative to the frame.

Screws 47, 48, 49 are inserted in openings, not shown, in inner housing shell 32 and are screwed into corresponding threaded openings, not shown, in outer housing shell 31 to retain frame legs 16, 18 in housing 23. Housing assembly 24 utilizes the same components as housing assembly 23, except for the drive motor. Housing 24 also includes a pivot pin supported by housing shells from which seat support leg 50 depends. If desired, a drive motor also can be utilized with housing 24.

Swing assembly 30 includes a U-shaped tubular member comprising seat support base 51 and seat support legs 39 and 50 which normally extend upward from the outboard ends of base 51. Seat 52 is a molded plastic member and includes back portion 53, front portion 54 and side portions 55, 56.

Clamp assembly 60 is fastened to seat side portion 55 and another clamp assembly 61 is fastened to seat side portion 56. The clamp assemblies can be plastic molded members which are either molded as an integral part of seat 52 or the clamp assemblies, if desired, can be releasably fastened by suitable fastener means to the sides of seat 52.

Figure 3:
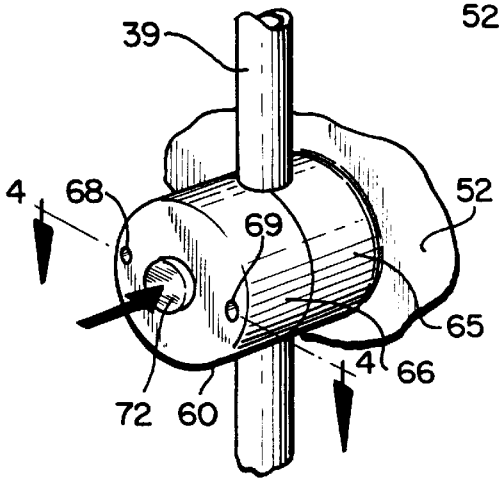
FIG. 3 shows an enlarged fragmentary view of one of the adjustable seat clamp assemblies for adjusting the seat to a desired height relative to the pivot pins.
Figure 4:
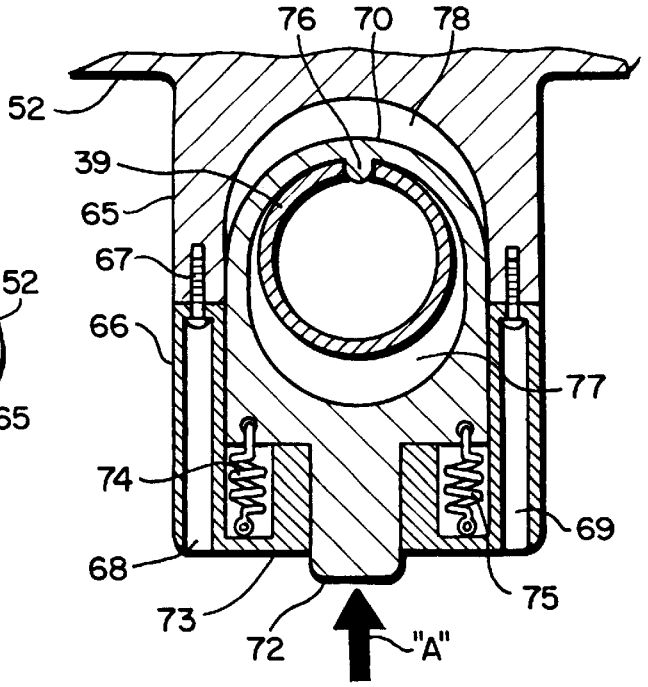
FIG. 4 shows a cross-section view taken along lines 4—4 in FIG. 3.

Referring to FIGS. 3 and 4, clamp assembly 60 includes clamp housings 65, 66. Inner housing 65 is integrally molded to seat 52. Outer clamp housing 66 is disposed to seat against housing 65 and is connected to housing 65 by means of threaded fasteners 67 which are adapted to enter fastener openings 68, 69 in housing 66 and screw into housing 65. A button member 70 is adapted to seat within corresponding recesses in clamp housing members 65, 66. Button 72 projects outward from button member 70. A pair of compression springs 74, 75 each have one spring end mounted to button member 70 while the remaining spring end is fastened to clamp housing 66. The springs serve to bias button member 70 in the direction opposite the direction of arrow "A" in FIG. 4 whereby button 72 normally extends beyond outer surface 73 of clamp housing 66.

Button member 70 also includes an oval shaped opening 77. A corresponding opening 78 is located in clamp housing 65. Detent 76 located on member 70 extends into opening 77.

Seat support leg 39 is mounted in opening 77 while seat support leg 50 is mounted in a similar opening in clamp assembly 61 which is identical in structure to clamp assembly 60. Detent 76 is adapted to normally seat in one of the openings 79 in support legs 39, 50 thereby locking the clamp assemblies to the seat support legs. By pushing in on button 72 of the respective clamp assemblies, button members 70 are urged inwardly in the direction indicated by arrow "A" in FIG. 4 whereby detent 76 is removed from opening 79 and clamp assemblies 60 and 61 are in an unlocked position relative to the seat support legs. Seat 52 then is capable of being moved up or down along the length of legs 39, 50 to another opening 79. Button 72 then is released whereby button member 70 returns to its normal biased position and detent 76 is positioned in a desired opening 79 whereby infant seat 52 is positioned in a desired position.

It will be appreciated that as the infant seat is moved upward and closed to the pivot pins, seat 52, upon actuation of drive motor 42, will travel an arcuate distance which is less than the arcuate distance travelled when swing seat 52 is located a greater distance away from the pivot pins. Moreover, when the seat is positioned close to pivot pin 37, the swing speed is slower as opposed to the speed at which the swing seat travels when it is located contiguous to seat support base 51. As a result, a mother, parent or other operator is able to adjust both the arcuate swing distance an infant will travel as well as the speed of seat travel. Moreover, if it is desired to feed a child in the open swing of the present invention, the seat can be adjusted to be locked in a fixed position contiguous to pivot pin 37 whereby access to the child can be achieved relatively easily.

It is appreciated that the various components of the device of the present invention can be made using any suitable plastic or metal materials utilized with open top swings presently available. Similarly, it is appreciated that other clamp locking systems can be utilized to adjust the location of the swing seat relative to the pivot pins.

It is also appreciated that while two swing support legs have been utilized, a swing assembly could, if desired, utilize one seat support leg which would extend from one of the mounting housings.

While the present invention has been described in connection with a single embodiment, it will be understood to those skilled in the art that many changes and modifications may be made without departing from the true spirit and scope of the invention. It is therefore intended by the appended claims to cover all such changes and modifications which come within the true spirit and scope of the invention.

What is claimed is:

1. An infant swing comprising:

a frame;

a motor supported by the frame;

at one support pivotally suspended from said frame for traversing a motion path when the motor is actuated;

a seat for receiving an infant, the seat being positionable at a first height and a second height; and at least one clamp assembly for securing the seat to the at least one support at at least one of the first and second heights, wherein when the seat is at the first height, the seat travels a first distance when the motor is actuated at a first speed, and, when the seat is at the second height, the seat travels a second distance when the motor is actuated at the first speed, wherein the first height is different than the second height and the first distance is different than the second distance.

2. A swing as defined in claim 1 wherein the clamp assembly defines a stop, the support defines a first opening, and the stop is dimensioned to mate with the first opening to secure the seat at the at least one of the first and second heights.

3. A swing as defined in claim 1 wherein a first one of the clamp assembly and the support defines a stop, a second one of the clamp assembly and the support defines a first opening, and the stop is dimensioned to mate with the first opening to secure the seat at the at least one of the first and second heights.

4. An infant swing, comprising:

a frame;

a motor supported by the frame;

at least one support pivotally suspended from said frame for traversing a motion path when the motor is actuated;

a seat for receiving an infant, the seat being positionable at a first height and a second height; and at least one clamp assembly for securing the seat to the at least one support at at least one of the first and second heights, wherein when the seat is at the first height, the seat swings at a first speed when the motor is actuated at a second speed, and when the seat is at the second height, the seat swings at a third speed when the motor is actuated at the second speed, wherein the first height is different than the second height and the first speed is different than the third speed.

5. A swing as defined in claim 4 wherein the clamp assembly defines a stop, the support defines a first opening, and the stop is dimensioned to mate with the first opening to secure the seat at the at least one of the first and second heights.

6. A swing as defined in claim 4 wherein a first one of the clamp assembly and the support defines a stop, a second one of the clamp assembly and the support defines a first opening, and the stop is dimensioned to mate with the first opening to secure the seat at the at least one of the first and second heights.

7. An infant swing, comprising:

a frame;

a motor;

at least one support pivotally suspended from said frame at a pivot point for traversing a motion path when the motor is actuated;

a seat having a seating surface for receiving an infant, the seat being positionable at a first height and a second height; and at least one clamp assembly for securing the seat at at least one of the first and second heights, wherein when the seat is at the first height, the seating surface is separated a first distance from the pivot point to cause the seat to travel a second distance when the motor is actuated at a first speed, and when the seat is at the second height, the seating surface is separated a third distance from the pivot point to cause the seat to travel a fourth distance when the motor is actuated at the first speed, wherein the first distance is different than the third distance and the second distance is different than the fourth distance.

8. An infant swing, comprising:

a frame;

a motor;

at least one support pivotally suspended from said frame at a pivot point for traversing a motion path when the motor is actuated;

a seat having a seating surface for receiving an infant, the seat being positionable at a first height and a second height; and at least one clamp assembly for securing the seat at at least one of the first and second heights, wherein when the seat is at the first height, the seating surface is separated a first distance from the pivot point to cause the seat to swing at a first speed when the motor is actuated at a second speed, and when the seat is at the second height, the seating surface is separated a second distance from the pivot point to cause the seat to swing at a third speed when the motor is actuated at the second speed, wherein the first distance is different than the second distance and the first speed is different than the second speed.

* * * * *